US007544083B2

(12) United States Patent
Tsukamoto

(10) Patent No.: US 7,544,083 B2
(45) Date of Patent: Jun. 9, 2009

(54) ELECTRIC PLUG

(76) Inventor: Tatusabu Tsukamoto, 2570, Ohaza Mukaizima Chiyodacho, Kanzaki-gun, Saga 842-0063 (JP)

( * ) Notice: Subject to any disclaimer, the term of this patent is extended or adjusted under 35 U.S.C. 154(b) by 0 days.

(21) Appl. No.: 10/598,477

(22) PCT Filed: Feb. 25, 2005

(86) PCT No.: PCT/JP2005/003710

§ 371 (c)(1),
(2), (4) Date: Jun. 1, 2007

(87) PCT Pub. No.: WO2005/083847

PCT Pub. Date: Sep. 9, 2005

(65) Prior Publication Data

US 2007/0281553 A1 Dec. 6, 2007

(51) Int. Cl.
*H01R 13/56* (2006.01)

(52) U.S. Cl. ..... 439/447; 439/483

(58) Field of Classification Search ..... 439/447, 439/483, 445

See application file for complete search history.

(56) References Cited

U.S. PATENT DOCUMENTS 2,034,966 A * 3/1936 Weich ..... 439/483
2,035,345 A * 3/1936 Schaefer ..... 439/447
2,727,088 A * 12/1955 La Wall ..... 174/135
3,521,220 A * 7/1970 Edwin, Jr. et al. ..... 439/447
5,058,172 A * 10/1991 Ross et al. ..... 381/122
5,340,330 A * 8/1994 Dolson et al. ..... 439/447
5,823,817 A * 10/1998 Pyle ..... 439/447
6,068,506 A * 5/2000 Shen ..... 439/447

(Continued)

FOREIGN PATENT DOCUMENTS

JP 48-52090 A 7/1973

(Continued)

OTHER PUBLICATIONS

International Search Report of PCT/JP2005/003710, date of mailing Apr. 26, 2005.

*Primary Examiner*—Gary F. Paumen
(74) *Attorney, Agent, or Firm*—Westerman, Hattori, Daniels & Adrian, LLP.

(57) ABSTRACT

An object is to provide an electric plug that can be pulled out silently and easily with one hand even from a power socket not secured without requiring any special device in or around a plug body. A front surface part and a back surface part to which the first finger and the second finger, respectively, of a gripping hand gripping the plug body are applied are provided on a forward end side of the plug body. A grip part for the third and subsequent fingers provided with a grip-shift stopper arranged at a part between a rear end of the front and back surface parts of the plug body and a position at a distance of about a four-finger width of the hand from the forward end of the plug body is provided. The electric plug can be pulled out from the socket by applying the first and second fingers of the gripping hand to the forward end side of the plug body, holding the grip part with the third and subsequent fingers, and then pushing the upper surface of the socket with the tip of the first finger.

10 Claims, 3 Drawing Sheets

U.S. PATENT DOCUMENTS 6,416,351 B1 * 7/2002 Ho ..... 439/447

FOREIGN PATENT DOCUMENTS

JP 49-84688 A 7/1974
JP 1-79281 U 5/1989
JP 1-100386 U 7/1989
JP 2003-514345 A 4/2003

* cited by examiner

ELECTRIC PLUG

TECHNICAL FIELD

The present invention relates to electric plugs widely used for drawing power from power sockets. The present invention particularly relates to an electric plug in which a forward end of a plug body is provided with pins projecting toward a socket in such a manner to be inserted into the socket, and a rear end of the plug body is provided with a cord extending therefrom.

BACKGROUND ART

Conventionally, it is sometimes unexpectedly troublesome to pull out an electric plug from a power socket. In particular, if the socket is not secured to a wall or the like, both hands have to be used to pull out the electric plug, as the socket has to be held with one hand. It is essentially difficult, due to a lack of stability, to pull out something that is tightly fitted in something without any point of support. For example, when a plug is pulled out with one hand from a socket placed in a small and recessed portioned space, force at the moment when the plug has been pulled out from the socket may cause the arm or hand to hit against nearby objects.

Examples of known plugs include a plug in which the rear of a plug body is provided with a finger hole or a string hole so that the plug can be easily pulled out with a finger or by pulling a looped string drawn through the string hole, and a plug in which a cord at the rear of a plug body is provided with a relatively long pipe or tab of plastic or rubber with a forward end secured to the plug body so that the plug can be pulled out by holding the pipe or tab with one hand. Although either of the above-described exemplary plugs can be pulled out without directly holding the plug with the hand, instability of the operation is still a problem. Either plug suffers a disadvantage in that pins of the plug may be bent when the plug is pulled out, or that force at the moment when the plug has been pulled out may cause the plug to hit against nearby objects. In particular, if a cord of a plug is covered with a squashy and stretchy pipe made of plastic or fabric, the cord is subjected to substantially the same pressure as that applied to the cord when directly pushed and pulled with a gripping force, and thus cannot be sufficiently protected from bending and pulling forces.

A plug in which a plug body is provided with a projecting lever or slide button on both sides or one side is advantageous in that it can be silently pulled out from a socket by operating the lever or slide button with fingers. However, such a plug is disadvantageous in that a special plug that is complicated in structure and large in size must be prepared.

Japanese Unexamined Utility Model Registration Application Publication No. 48-52090 discloses an exemplary plug in which a grip part is provided at a rear end of a plug body so that the plug can be pulled out by holding the grip part. The entire pulling hand is located in the grip part at the rear of the plug body. The grip part with a finger grip at its rear end has a length of about a hand's width from the rear end of the plug body.

Japanese Unexamined Utility Model Registration Application Publication No. 49-84688 discloses a plug designed to eliminate a cause of a break in a cord of the plug in an automatic cord rewinder for an electrical appliance. A rear portion of an insulator forming a holding part of the plug is partially narrowed and the subsequent portion is made larger than an opening of the automatic cord rewinder. The plug can also be pulled out by directly holding this larger portion. The narrower portion forward of the larger portion is for absorbing the shock of the collision of the plug with the opening of the automatic rewinder. The length, thickness, and the like of the narrower portion are determined according to the hardness of the material of the insulator to be used.

Japanese Unexamined Utility Model Registration Application Publication No. 1-79281 discloses a mechanism relating to a plug to be inserted into many closely spaced connector jacks, which cannot be reached with hands, for a communication device or the like. As an alternative of a conventional plug in which a band plate-like pull-out tab is provided at the rear of a plug case, a plug in which a tubular mating/unmating member projects rearward from the rear of a plug case in such a manner to cover the outside of a cable is provided so that the plug can be inserted into and removed from a fixed connector jack by gripping the mating/unmating member.

A typical electric plug is configured such that it can be inserted and removed by directly holding a plug body. However, in many proposed electric plugs, various additional means for pulling out a plug are provided at the rear of a plug body or the like. Electric plugs of such a type, however, have not yet been widely used up to now.

It is preferable that the pushing force of the first finger (thumb) be used to pull out an electric plug safely and easily with one hand. To transmit the force of pushing a socket surface with the first finger to a plug body, it is important that a rear part of the plug body be gripped with the remaining fingers to prevent slippage. It is also important to prevent strain on the fingers. In other words, the gripped portion needs to have a form and properties that can resist a lateral force in the direction of slippage without placing excessive strain on the fingers.

An object of the present invention is to provide an electric plug that can be pulled out silently and easily from a socket with one hand regardless of whether the socket is secured.

Another object of the present invention is to provide an electric plug that can be pulled out with a simple means without requiring any special device in or around the plug body.

Another object of the present invention is to provide an electric plug that can be pulled out with a means that does not excessively protrude at the rear of the plug body and does not cause any obstruction.

DISCLOSURE OF INVENTION

The present invention provides an electric plug in which a forward end of a plug body is provided with pins projecting toward a socket in such a manner to be inserted into the socket, and a rear end of the plug body is provided with a cord extending therefrom. The plug body has, on the forward end side, a front surface part to which the first finger of a gripping hand gripping the plug body when the plug body is pulled out is applied and a back surface part supported by the second finger of the gripping hand. A grip part for the third and subsequent fingers provided with a grip-shift stopper arranged at a part between a rear end of the front and back surface parts of the plug body and a position at a distance of about a four-finger width, extending from the second through fifth fingers, of the gripping hand from the forward end of the plug body is provided. The electric plug is pulled out by pushing an upper surface of the socket with the first finger.

The grip-shift stopper may be a bulging portion formed at a rear end of the grip part.

The grip-shift stopper may be a grip part separated from the cord extending from the rear end of the plug body, and extending with a substantially constant thickness or an increasing thickness toward the rear to cover the outer surface of the cord.

The grip-shift stopper may be a grip part provided in the plug body having a shape of a substantially rectangular prism extending from the forward end thereof with a substantially constant thickness or an increasing thickness toward the rear, and located at and after the position of the third finger of the gripping hand.

BEST MODE FOR CARRYING OUT THE INVENTION

Embodiments of the present invention will now be described with reference to the drawings.

Figure 1:
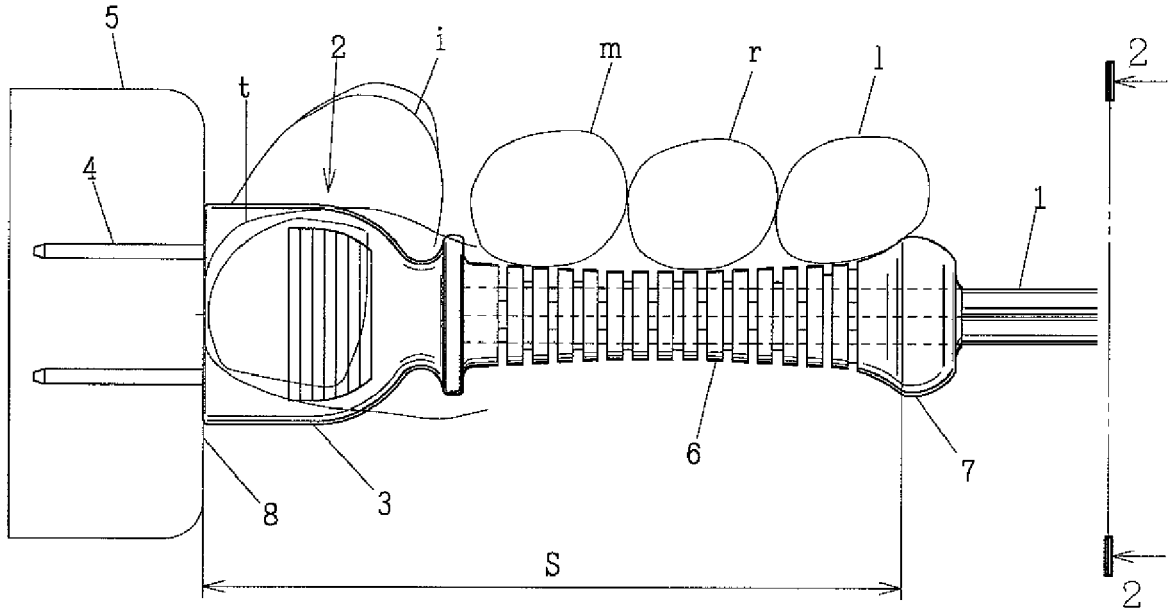
FIG. 1 is a front view of a plug in a socket.
Figure 2:
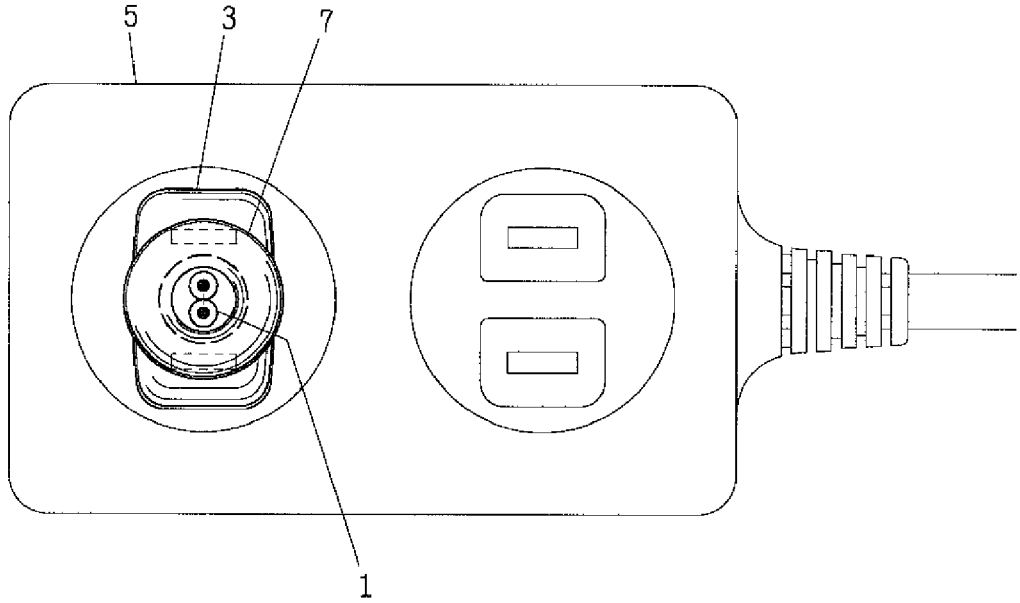
FIG. 2 is a view on arrow 2-2 of FIG. 1.

In an embodiment illustrated in FIG. 1 and FIG. 2, a plug 2 at an end of a cord 1 extending from an electric device is provided with two pins 4 at a forward end of a plug body 3. The pins 4 are inserted into a socket 5 to use the plug 2. For stable power delivery, the pins 4 are securely held in the socket 5. Many electric cords for home appliances are flexible and each cord consists of two round coated wires integrally arranged side-by-side. A portion of the plug body 3 from which the cord is drawn is typically provided with a short protective bushing, which is moderately bent to protect the cord from being damaged. Here, a grip part 6 extends rearward from a rear end of the plug body 3 to cover the outer surface of the cord 1. The grip part 6 is separated from the cord 1, provided with many transverse grooves similar to those of a protective bushing, and is flexible. A thick bulging portion 7 is formed at an end rearward of the grip part 6. A distance "S" from the forward end of the plug body 3 to the bulging portion 7 is about 70 mm. The grip part 6 is about 8.5 mm in thickness and nearly circular. Imaginary lines in the drawing indicate the positional relationship of fingers when the plug 2 is to be pulled out. The first finger (thumb) stat is applied to a front surface of the plug body 3. The second finger (index finger) "i" is applied to support a back surface of the plug body 3. The third finger (middle finger) "m", the fourth finger (ring finger) "r", and the fifth finger (little finger) "l" grip the grip part 6 in a manner to hold the plug body 3 from the backside. From this state, the first finger "t" slides forward to push an upper surface 8 of the socket 5 with the tip of the first finger "t". Thus, the plug 2 can be silently pulled out from the socket 5. At this point, the rear side of the fifth finger "l" is pressed against the bulging portion 7. This prevents the fingers gripping the grip part 6 from shifting rearward. Therefore, it is only necessary for the fingers holding the grip part 6 to lightly grip the grip part 6, as the bulging portion 7 effectively performs a grip-shift stopping function. Thus, the bulging portion 7 is positioned immediately behind the rearmost finger gripping the grip part 6. When the first finger "t" pushes the upper surface 8 of the socket, the forward side of the second finger "i" may simultaneously push the upper surface 8 of the socket. The grip part 6 is reinforced at the base to which the plug body 3 is connected.

Figure 3:
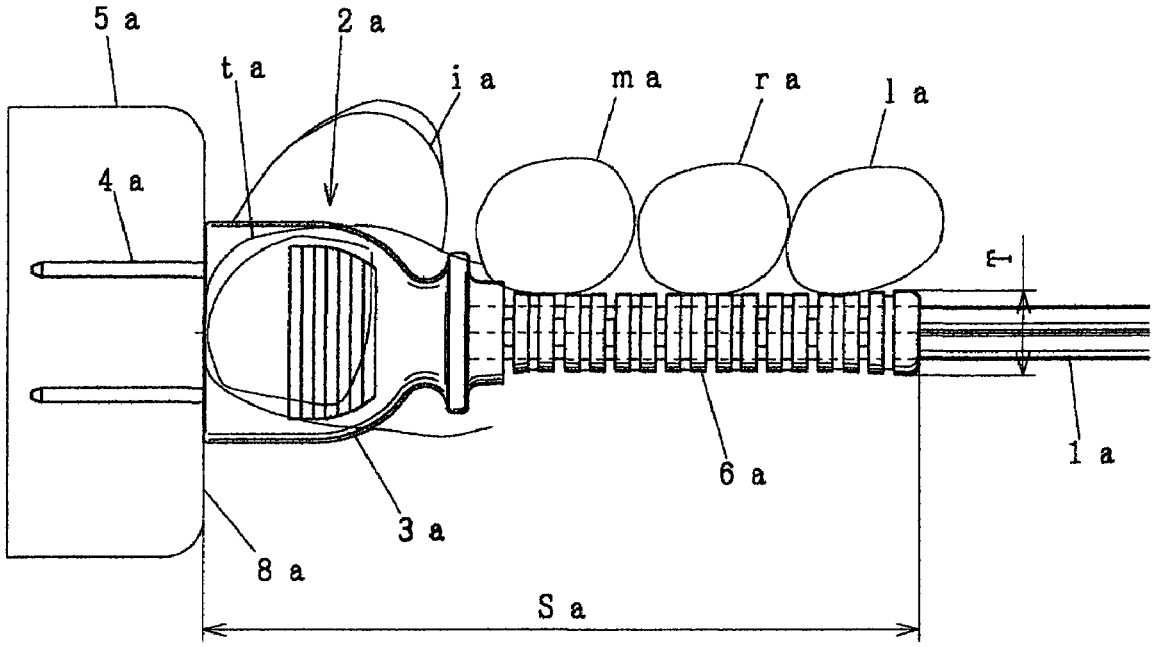
FIG. 3 is a front view of a plug according to another embodiment of the present invention.

FIG. 3 illustrates another embodiment. In the following embodiments, the same components as those of the above-described embodiment are designated by the same reference numerals with subscripts a, b, c, and d corresponding to the respective embodiments. The detailed descriptions of the same components are omitted, and different components are mainly described. When the plug is pulled out in a manner described above, it is very difficult and cumbersome to securely grip a thin object with the third through fifth fingers so as to prevent slippage. In the present embodiment, a bulging portion such as that described above is not provided. Instead, a straight grip part 6*a* extending rearward from a rear end of a plug body 3*a* to cover the outer surface of a cord 1*a* is provided. A distance "Sa" from the forward end of the plug body 3*a* to the rear end of the grip part 6*a* is about 75 mm. The cord 1*a* is 5.3 mm in width and 2.6 mm in thickness, while the grip part 6*a* is about 8.5 mm in thickness "T" and nearly circular. The grip part 6*a* is separated from the cord 1*a*. The thickness of the grip part 6*a* is determined such that the grip part 6*a* is not easily deformed by grip pressure and can be easily gripped. The grip part 6*a* is provided with many transverse grooves similar to those of a protective bushing. However, unlike the protective bushing, the grip part 6*a* does not taper rearward. The grip part 6*a* is constant in thickness or becomes rather slightly thicker toward the rear. Therefore, the third finger "ma", the fourth finger "ea", and the fifth finger "la" can securely grip the grip part 6*a* without any particular difficulty and in a normal manner. Then, the grip part 6*a* receives via the third finger the force of pushing an upper surface 8*a* of a socket 5*a* with the first finger "ta", and exerts resistance to a rearward shift, the resistance being sufficiently large to be transmitted to the plug body 3*a*. In other words, the grip part 6*a* itself effectively performs a grip-shift stopping function. It is preferable that the grip part 6*a* be not easily deformed even if it is tightly gripped to some extent. The grip part 6*a* does not necessarily have to be provided with many transverse grooves such as those described in this example, and may be formed of rubber material or the like that is moderately firm and resistant to slippage. As for the shape, it is important that the grip part 6*a* extends with a substantially constant thickness or an increasing thickness toward the rear. This means that the grip part 6*a* can either be thickened or even be unnoticeably slightly narrowed, but cannot be visibly narrowed toward the rear.

Figure 4:
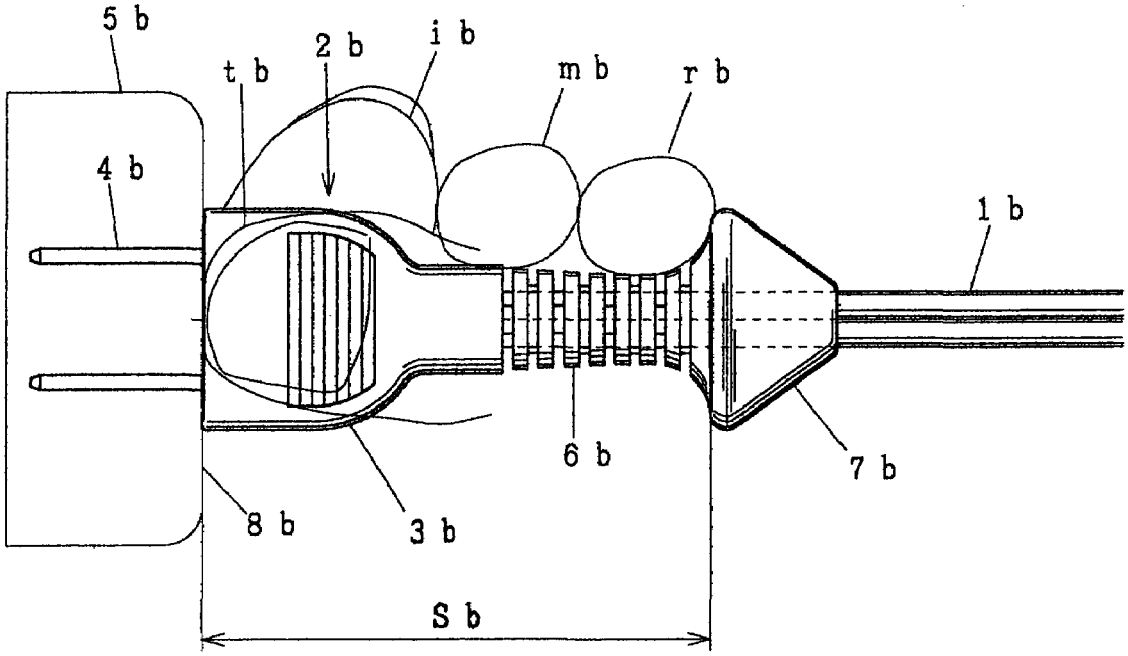
FIG. 4 is a front view of a plug according to still another embodiment.

The length of the grip part can further be reduced. FIG. 4 illustrates such an embodiment. Here, a distance "Sb" from the forward end of a plug body 3*b* to a bulging portion 7*b* is about 50 mm. Imaginary lines in the drawing indicate the positional relationship of fingers when a plug 2*b* is to be pulled out. Two fingers, that is, the third finger "mb" and the fourth finger "rb" are placed between a plug body 3*b* and a thick bulging portion 7*b* having a vertical end surface. A grip part 6*b* is gripped from the backside thereof with these two fingers. Here, the number of applied fingers and the depth of grip vary depending on the hand size of the user. As a resistance against the force of pushing an upper surface 8*b* of a socket with the tip of the first finger "tb", the rear side of the fourth finger "rb" is pressed against the bulging portion 7*b*. This allows a grip-shift stopping function to be performed and thus allows the plug 2*b* to be easily and silently pulled out from the socket 5*b*.

Figure 5:
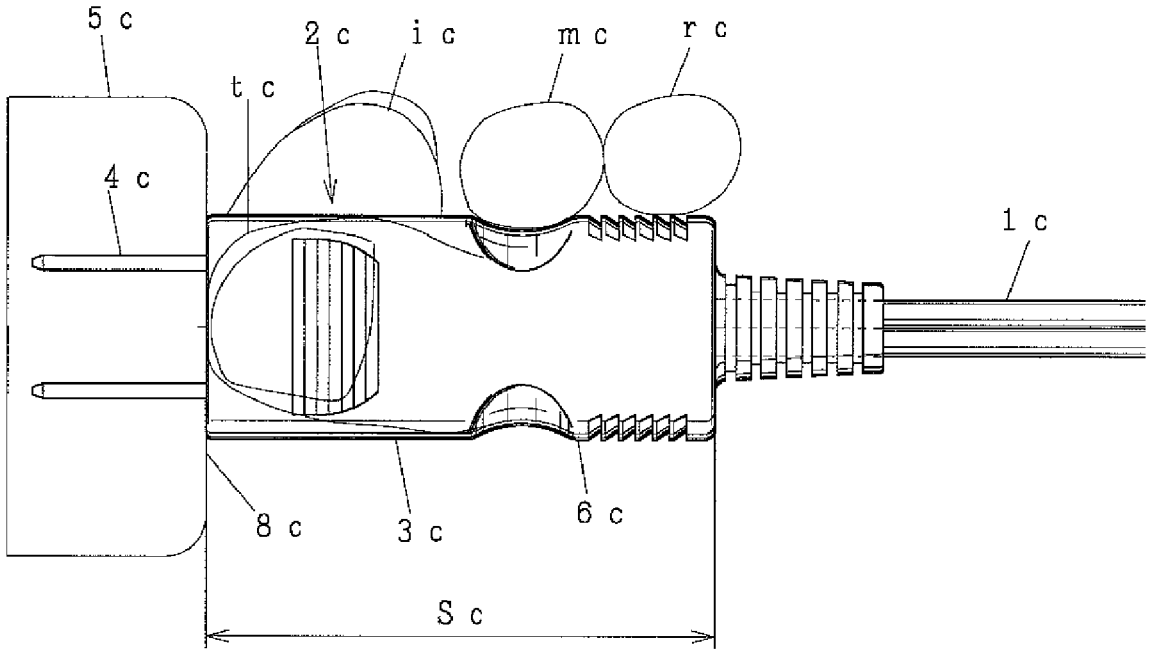
FIG. 5 is a front view of a plug according to still another embodiment.

A grip part may be formed in the plug body. FIG. 5 illustrates an example in which a short grip part 6*c* is formed in a short plug body 3*c*. Here, the plug body 3*c* has the shape of a rectangular prism extending rearward in a straight line from its forward end. A length "Sc" from the forward end to the rear end is about 50 mm, which is much longer than that in the case of a typical plug of this type. Imaginary tines in the drawing indicate the positional relationship of fingers when a plug 2*c* is to be pulled out. As indicated, the grip part 6*c* at the rear of the plug body 3*c* is gripped with two fingers, that is, the third finger "mc" and the fourth finger "rc" from the backside. With the plug body 3*c* having this shape, the grip part 6*c* can be sufficiently securely gripped with the third finger "mc" and the fourth finger "ec". Again, a grip-shift stopping function is performed against the force of pushing an upper surface Sc of a socket with the first finger "tc". Thus, the plug 2*c* can be pulled out from the socket 5*c* without any difficulty. It is important again that the grip part 6*c* extends with a substantially constant thickness or an increasing thickness toward the rear so that the anti-shift function can be effectively performed. It is important that the grip part 6*c* does not visibly taper rearward, and it is preferable, if possible, that the grip part 6*c* be thickened toward the rear end. To prevent fingers from slipping, it is preferable that the grip part be provided with a recessed portion or sawtooth notches in and around areas where fingers are to be placed or provided with asperities on the entire surface thereof, or that the plug body be made of material resistant to slippage.

Figure 6:
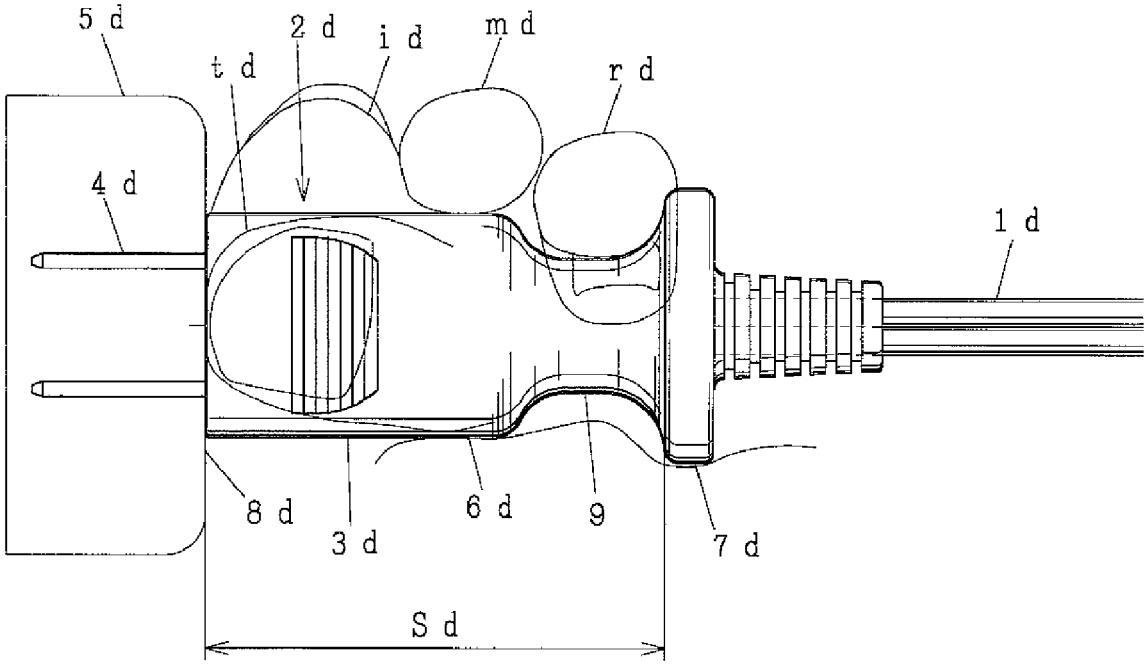
FIG. 6 is a front view of a plug according to still another embodiment.

FIG. 6 illustrates another embodiment in which a grip part is provided in a plug body. Here, a recessed portion 9 is formed at the rear of a grip part 6*d* of a plug body 3*d*, and a bulging portion 7*d* is provided behind the recessed portion 9. A distance "Sd" from the forward end of the plug body 3*d* to the bulging portion 7*d* is about 45 mm. Imaginary lines in the drawing indicate the positional relationship of fingers when a plug 2*d* is to be pulled out. As indicated, the fourth finger "rd" is placed in the recessed portion 9 and securely grips the grip part 6*d* such that a side of the grip part 6*d* adjacent to the bulging portion 7*d* is pressed against the palm. This further enhances resistance to the rearward shift of fingers gripping the grip part 6*d*. A grip-shift stopping function can be sufficiently performed by two fingers, that is, the third finger "md" and the fourth finger "rd".

As described above, the shape, dimensions, properties, and the like of a portion in and around the grip part, such as a portion where the bulging portion is located, are closely related to the method of pull-out operation initially described, and are determined to be appropriate for the method. Each grip part of the above-described embodiments is provided with a grip-shift stopper that is capable of performing a grip-shift stopping function sufficient for pulling out the plug.

With the above-described configuration of the present invention, it is possible to provide an electric plug that can be easily pulled out, even from a socket not secured, by gripping the rear part of the plug including a plug body with one hand and pushing the upper surface of the socket with the first finger.

Moreover, it is possible to provide an electric plug that can be pulled out with one hand with a simple plug configuration without requiring any special device in or around the plug body.

Moreover, with a grip part having a bulging portion at the rear end, it is possible to provide an electric plug that can be further easily pulled out while reducing adverse effects on a cord.

INDUSTRIAL APPLICABILITY

The present invention is widely applicable to electric plugs including those for household use.

The invention claimed is:

1. An electric plug comprising:

a plug body having a front surface part and a back surface part adapted to be held with a first finger and a second finger of a gripping hand when said plug is pulled out, said plug body having a forward end and a rear end;

at least two pins extending from the forward end of said plug body;

a cord extending from the rear end of said plug body; and a flexible grip part extending rearwards from the rear end of said plug body and covering outer surface of said cord, said grip part being provided with a bulging portion at a rear end thereof, wherein a distance from the forward end of said plug body to the bulging portion is about 45 mm to about 70 mm.

2. The electric plug as claimed in claim 1, wherein said distance from the forward end of said plug body to said bulging portion is about 70 mm.

3. The electric plug as claimed in claim 1, wherein said distance from the forward end of said plug body to said bulging portion is about 50 mm.

4. The electric plug as claimed in claim 1, wherein said grip part is shaped such that thickness of the grip part gradually increases toward bulging portion.

5. The electric plug as claimed in claim 1, wherein said grip part extends with a substantially constant thickness toward the bulging portion and the bulging portion have a thick and vertical front end surface.

6. An electric plug comprising:

a plug body adapted to be held with a first finger and a second finger of a gripping hand when said plug is pulled out, said plug body having a forward end and a rear end;

at least two pins extending from the forward end of said plug body; and a cord extending from the rear end of said plug body; and a grip part extending rearwards from said plug body, said grip part being provided with a bulging portion at a rear end thereof, wherein a distance from the forward end of said plug body to the bulging portion is about 45 mm to about 70 mm.

7. The electric plug as claimed in claim 6, wherein said distance from the forward end of said plug body to said bulging portion is about 70 mm.

8. The electric plug as claimed in claim 6, wherein said distance from the forward end of said plug body to said bulging portion is about 45-50 mm.

9. The electric plug as claimed in claim 6, wherein said grip part is shaped such that thickness of the grip part gradually increases toward bulging portion.

10. The electric plug as claimed in claim 6, wherein said grip part has a recessed portion at least at a rear portion thereof.

* * * * *